US005690231A

United States Patent [19]

Erickson

[11] Patent Number: 5,690,231

[45] Date of Patent: Nov. 25, 1997

[54] CLAY SCULPTURING KIT

[75] Inventor: Steve Erickson, Minneapolis, Minn.

[73] Assignee: Sculptura, Incorporated, Minneapolis, Minn.

[21] Appl. No.: 534,162

[22] Filed: Sep. 26, 1995

[51] Int. Cl.[6] ..... B65D 69/00

[52] U.S. Cl. ..... 206/573; 206/232; 206/575

[58] Field of Search ..... 206/575, 223, 206/232, 579, 349, 45.32, 573; 35/26

[56] References Cited

U.S. PATENT DOCUMENTS

| | | | |
|---|---|---|---|
| D. 282,534 | 2/1986 | Morgan et al. . | |
| 1,458,508 | 6/1923 | Aiken . | |
| 3,035,689 | 5/1962 | Arnheiter . | |
| 3,826,020 | 7/1974 | Zutz . | |
| 3,921,801 | 11/1975 | Sway . | |
| 3,945,490 | 3/1976 | Thompson | 206/575 |
| 4,003,142 | 1/1977 | Morrison et al. | 35/26 |
| 4,129,213 | 12/1978 | Fleig . | |
| 4,703,930 | 11/1987 | Gilbert . | |
| 4,828,114 | 5/1989 | Bardeen | 206/575 |
| 5,100,324 | 3/1992 | Slayton | 206/579 |
| 5,379,887 | 1/1995 | Conley, Jr. | 206/232 |

*Primary Examiner*—Paul T. Sewell
*Assistant Examiner*—Luan K. Bui
*Attorney, Agent, or Firm*—Merchant, Gould, Smith, Edell, Welter & Schmidt, P.A.

[57] ABSTRACT

A clay sculpturing kit is described which is used to shape clay, store clay and display the finished sculpture. The clay sculpturing kit includes a base and a covering where the base receives the covering such that the base is obscured from view. The concept of using the same device as a work place for shaping the clay and also for displaying the clay is made possible by a surface which is easily wiped clean after the clay is sculptured into a final piece of art.

9 Claims, 4 Drawing Sheets

CLAY SCULPTURING KIT

BACKGROUND OF THE INVENTION

The present invention relates to a clay sculpturing kit for fashioning and shaping clay on a top surface, displaying a clay sculpture and also for storing clay sculpturing materials when not in use.

Historically people have played with clay or other like substances such as Play-doh™ and made different shapes. However, the finished shape is placed back in the storage container. For example, Play-doh™ comes in a cylindrical container and the user plays with the substance for a while and then puts it back in the container.

The concept of fashioning the clay on a pedestal, then wiping the pedestal clean such that the pedestal is eye appealing and then displaying the finished product on the pedestal is not considered in the clay and hobby kits of the prior art. As a result, none of the existing clay kits have a housing or storage container which is suitable for also serving as a pedestal for displaying the sculptured clay form on an aesthetically pleasing pedestal. These prior art kits merely store the clay and/or provide a method for carrying the clay. For example, the prior art includes a cardboard box for holding chord, rope, pieces of cloth, or other materials for forming animal figures. However this cardboard box is used merely to store the supplies and the finished art form.

The present invention provides a novel clay kit apparatus not disclosed in the prior art.

SUMMARY OF THE INVENTION

The present invention relates to a clay sculpturing kit which provides a surface for fashioning clay, displaying a clay sculpture, and also used for storing clay sculpturing materials when not in use.

In one embodiment the invention includes a pedestal having a skid resistant support member which minimizes the likelihood of the pedestal sliding across the surface of the work or display space such as a desk.

In one embodiment of the present invention the pedestal comes apart into two pieces, a base and a covering. The space enclosed by the two pieces of the pedestal is used to store the clay and clay shaping tools. When the pedestal is being used to support and display the sculpture a person viewing the pedestal cannot see the joint between the base and the covering. The absence of any lines or joints in the pedestal results in a device which is aesthetically pleasing such that it serves as a pedestal.

Yet another embodiment of the present invention includes a light source on the inside of the pedestal. Light from this light source shines upon the sculpture by passing through an aperture in the pedestal.

These and various other advantages and features of novelty which characterize the invention are pointed out with particularity in the claims annexed hereto and forming a part hereof. However, for a better understanding of the invention, its advantages and objects obtained by its use reference should be had to the drawings which form a further part hereto and to the accompanying descriptive matter in which there is illustrated and described a preferred embodiment of the invention.

BRIEF DESCRIPTION OF THE DRAWINGS

In the drawings in which like reference numerals and letters generally indicate corresponding parts throughout the several views.

DETAILED DESCRIPTION OF THE PREFERRED EMBODIMENT

Figure 1:
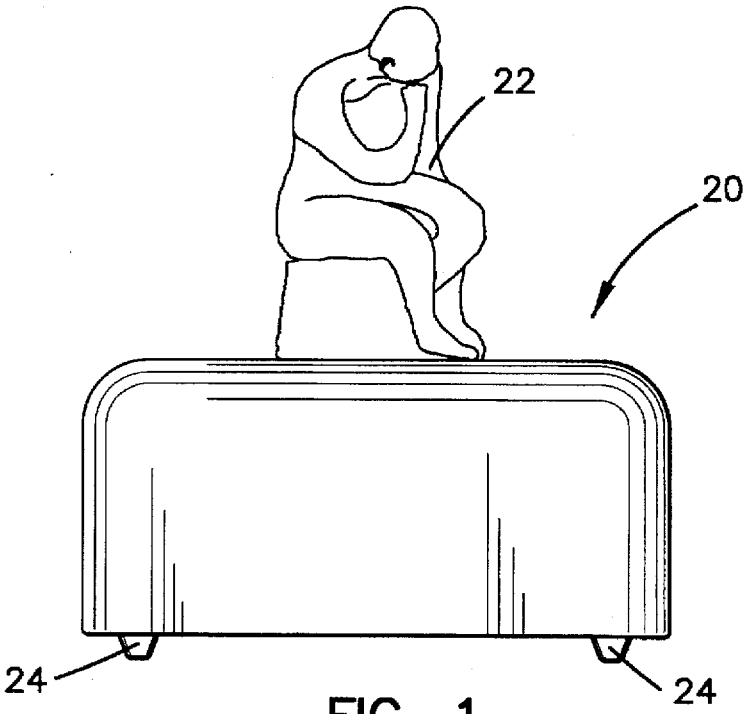
FIG. 1 shows a side view of an embodiment of a clay sculpturing kit in accordance with the principles of the present invention with an example sculpture sitting on top of the pedestal of the clay sculpturing kit.

Referring now to the figures there is shown in FIG. 1 an embodiment of a clay sculpturing kit in accordance with the principles of the present invention, the clay sculpturing kit being generally referenced by the reference numeral 20. FIG. 1 shows an example of a sculpture 22 sitting on top of a pedestal 25 of the clay sculpturing kit 20.

Figure 2:
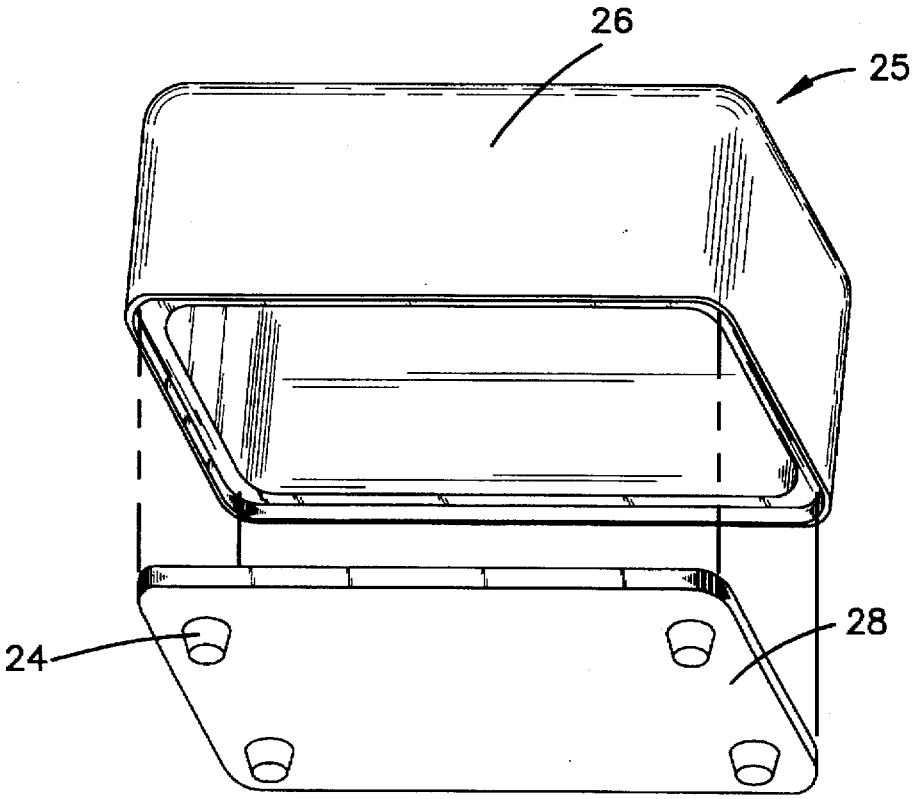
FIG. 2 is a three-dimensional drawing of the pedestal separated into a covering and a base.

FIG. 2 shows a covering 26 and a base 28 of the pedestal 25. The base 28 fits into the covering 26 such that when the pedestal 25 is used to display a clay sculpture the covering 26 obscures the base 28 from view. However, as shown in FIG. 1, skid resistant supports 24 can be seen in the preferred embodiment shown.

Figure 3:
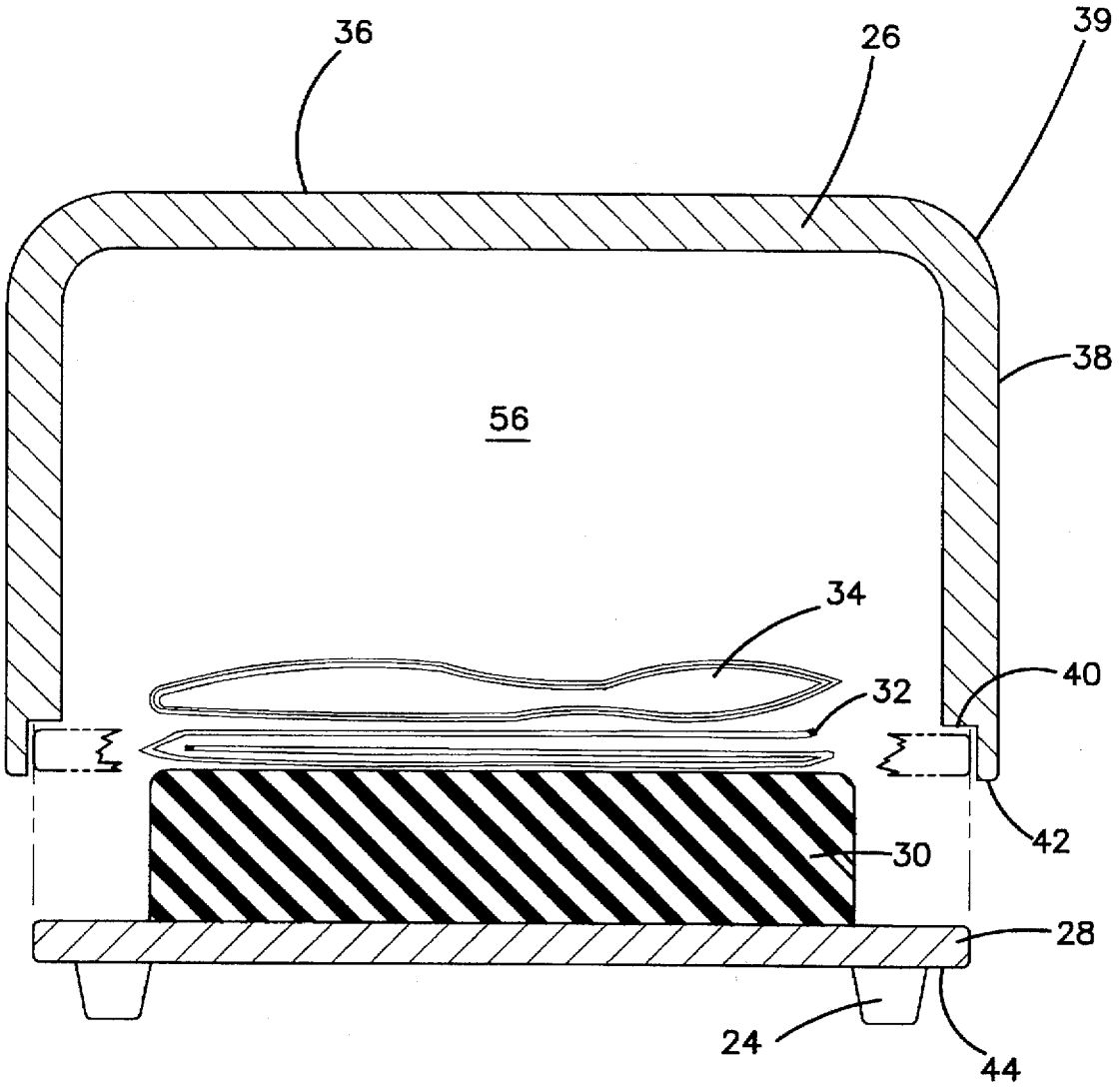
FIG. 3 is a cross-sectional view of the pedestal, an amount of clay, a sculpturing tool and instruction materials being disposed on the base of the pedestal.

FIG. 3 shows how the covering 26 and the base 28 are used to store an amount of clay 30, instruction materials 32 and at least one clay shaping tool 34 in a space 56 enclosed by the covering 26 and the base 28.

The covering 26 includes a top surface 36 and a side wall 38. The bottom portion of side wall 38 is notched to create an inner bottom edge 40 and an outer bottom edge 42. When the covering 26 is received by the base 28, the covering 26 rests on the base 28 along the inner bottom edge 40. The outer bottom edge 42 extends proximate to or below the bottom surface 44 of the base 28 such that the covering 26 obscures the base 28 from view.

A preferred embodiment of the present invention has a smooth and rounded transition or arcuate surface 39 from the top surface 36 of the covering 26 to the side wall 38 of the covering 26. This smooth transition results in a more aesthetically pleasing pedestal 25.

Figure 4:
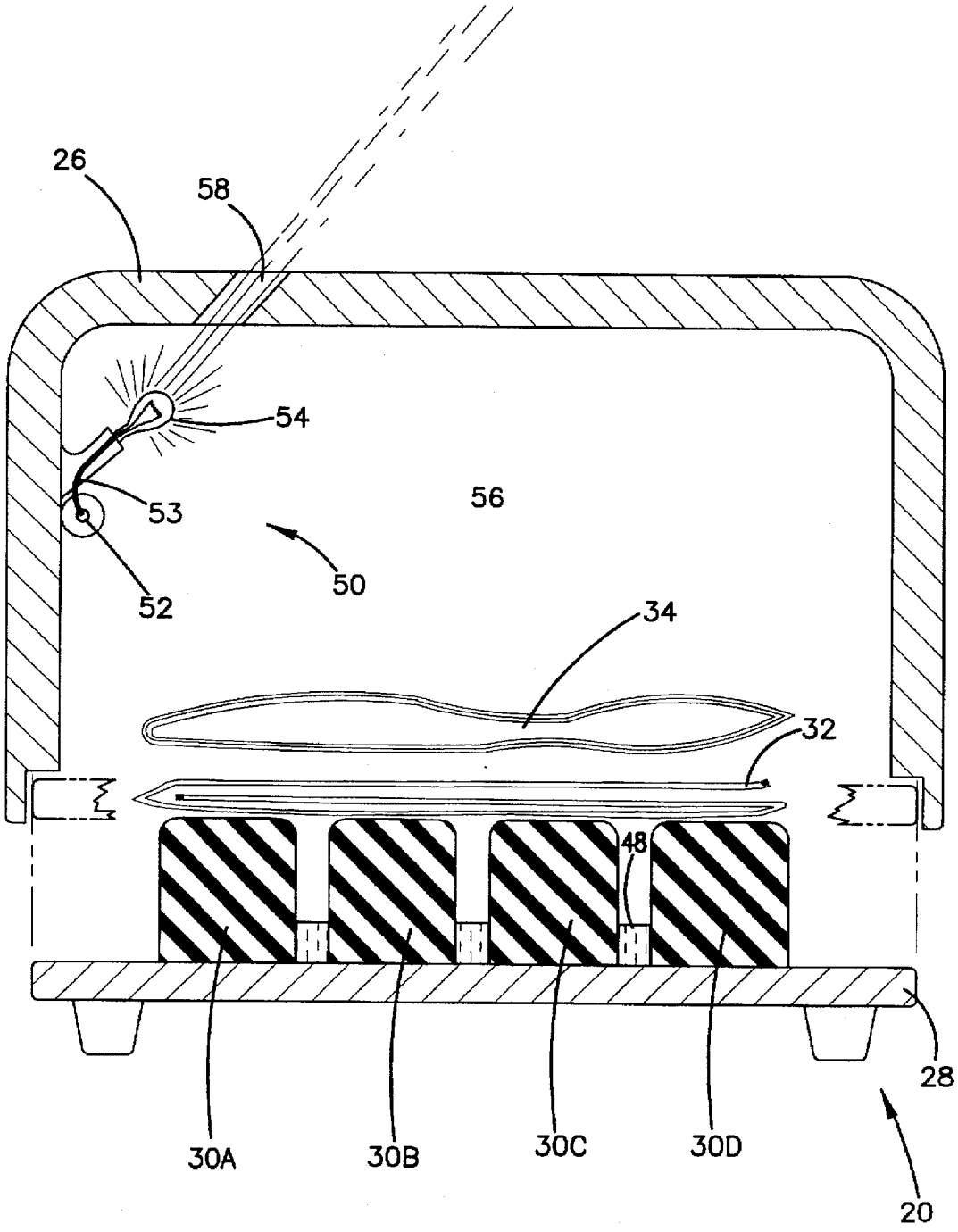
FIG. 4 is a cross-sectional view of an alternative embodiment of the invention showing four pieces of clay, instruction materials and a clay shaping tool in the stored position, also shown is a light source and battery with light showing through an aperture in the pedestal.

Another embodiment of the invention is shown in FIG. 4. In this embodiment there is more than one block of clay. Separate blocks 30 A,B,C,D of the clay 30 are separated from one another by partitions 48 that are attached to the top surface of the base 28. In this embodiment the separate blocks of clay 30 A,B,C,D can be different colored clay and the partitions 48 separate the different colored clay. For purposes of example only, the partitions 48 could be ½ inch high by ½ inch wide by 4 inches long.

A light source 50 including a power source 52, a light bulb 54 and an electrical conduit 53 can be placed somewhere in the space 56. An aperture 58 in the covering 26 is placed such that the light from the light bulb 54 shines through the aperture 58 and illuminates the sculpture which is sitting on top of the covering 26. The aperture 58 can be cut diagonally through the covering 26 so the light is directed to shine on the sculpture. Note that the power source 52 could be either a battery or it could be an external source of power, such as a conventional AC outlet.

Figure 5:
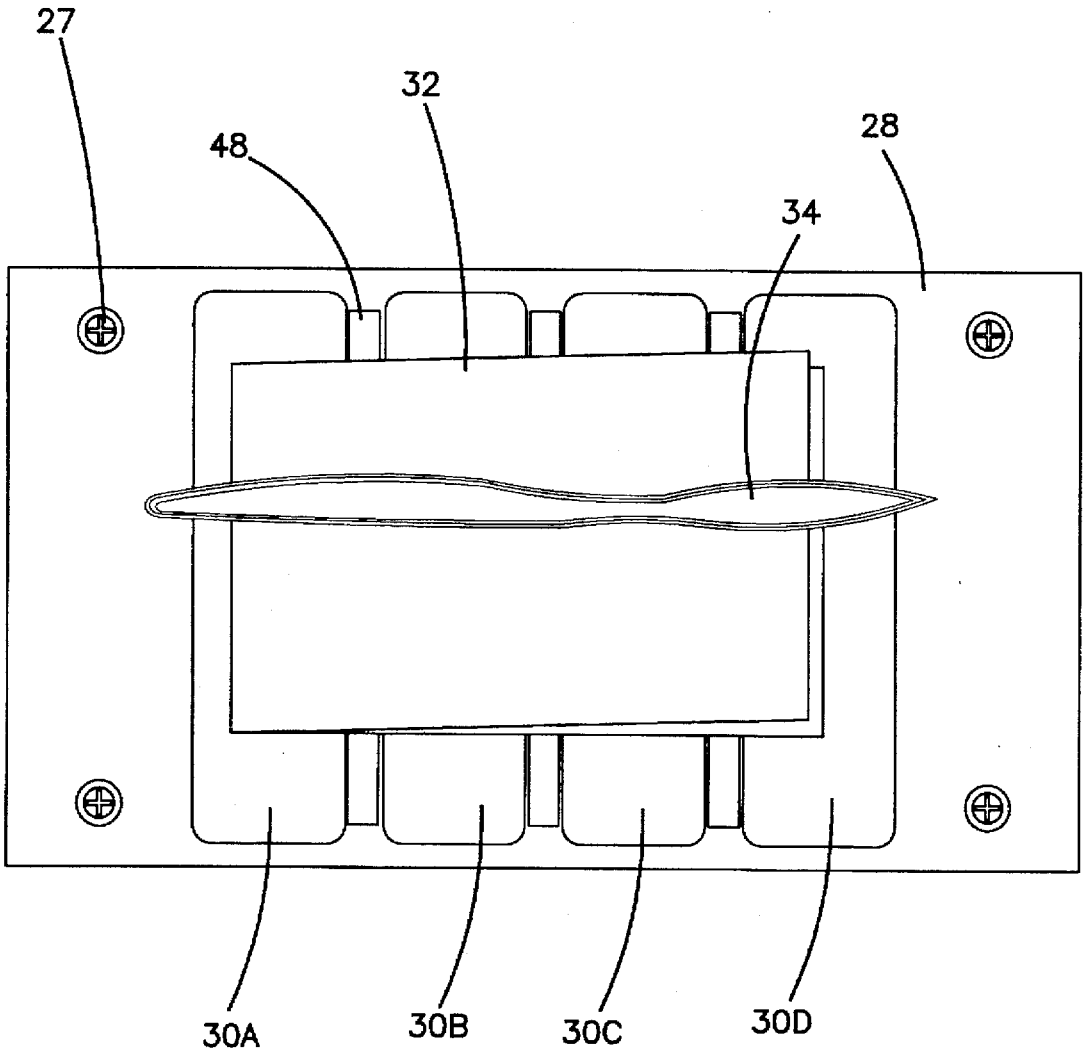
FIG. 5 is a top view of the base shown in FIG. 4 of the pedestal, bars of clay, instruction materials and clay shaping tool.

In one exemplary embodiment, the shape of the covering 26 and base 28 is substantially rectangular. FIG. 5 shows the base 26 in a rectangular embodiment. The dimensions of the base and covering might be 7×4.5×2 inches. This substantially rectangular embodiment also shown in FIG. 2 can include four skid resistant supports 24 which are attached to the bottom surface 44 of the base 28. The skid resistant supports 24 might be attached to the base 28 by screws 27 as shown in FIG. 5. The skid resistant supports are made of a skid resistant material, one example would be rubber. It will be appreciated that the covering 26 and base 28 might have any number of shapes and configurations including but not limited to oval, circular and square.

The covering 26 might be any color. One embodiment might have a dark colored covering 26 and a lighter or off-white colored skid resistant supports 24. In the preferred embodiment the covering 26 is hard, glossy and opaque. Such a hard, glossy and opaque surface allows the top surface 36 of the covering 26 to be used as a place to fashion and shape the clay and then also as a pedestal. The top surface 36 and the side walls 38 can be easily cleaned and shined to add a high gloss eye appealing finish for use as a pedestal.

The covering 26 can be made of ABS (Acrylonitride-Butadiene-Styrene) a material commonly used to produce a wide variety of plastic items. The covering 26 and base 28 can be injection molded using a standard molding technology. The inside of the mold is polished to a very smooth surface. This then creates a very smooth and polished top surface 36 and side wall 38.

The purpose of the high gloss finish is to allow the user to fashion and shape the clay on the top surface 36 of the covering 26 and then wipe the top surface 36 and side walls 38 clean such that the covering 26 has an eye appealing, high gloss finish which is suitable to be used to display the sculpture. The high gloss finish on the covering 26 also prevents stains so that after shaping the clay on the top surface 36, the covering 26 can be wiped clean and then used to display the sculpture without the presence of stains which ruin the appearance of the covering 26.

An optional embodiment of the invention is a glow in the dark covering 26. For example, a light lime green covering 26 that would glow in the dark. Another optional embodiment is a glow in the dark clay 30.

In one embodiment the bottom of the covering 26 might have a special snap or latch to keep the base 28 attached to the covering 26 when the covering 26 is lifted up.

In a further embodiment of the present invention the covering 26 is pivotally attached to the base 28 by a hinge. The hinge could be inset into the covering 26 such that the hinge would not be visible when the covering 26 is closed down upon the base 28.

The clay 30 might be one pound of off white clay with dimensions 4×3×1.5 inches. The clay might alternately be four bars of clay 30 A,B,C,D as shown in FIG. 4. Each bar of clay 30 A,B,C,D could be a different color and weigh approximately 0.25 pounds, with dimensions 3×1.5×1 inches.

The clay 30 preferably includes the following characteristics: non-hardening, reusable and non-toxic. Ideally the clay 30 becomes more pliable with use due to warmth created by the hands. An example clay would be Van Aken International plastalina™ non-hardening clay.

Another option would be to include a hardening clay for permanent display. The hardening clay could be hardened by either the air drying application or the oven baked application, both of which are well known in the art.

It will be appreciated that other tool accessories might be included in the clay sculpturing kit 20; for example, paints, brushes and tools for brushing texture into the clay 30 or for painting the clay 30. The dowels can be used for supporting the clay including but not limited to creating arms and legs in a sculpture of a human figure. Clay can be placed around the dowels such that the dowels support the clay.

The dowels might be made of a plastic material. One embodiment of the clay kit has eight dowels, each dowel being one inch in length.

The instruction materials 32 might also contain a history of the art of sculpturing. This history might include information on the origins of this form of art and other interesting information about sculpturing.

A logo or an identifying mark or other indicia might be affixed on the side wall 38 of the covering 26. This might include an adhesive label or might be molded into the side wall 38.

It is to be understood that even though numerous characteristics and advantages of the present invention have been set forth in the previous description, together with details of the structure and function of the invention, the description is illustrative only, and changes may be made in detail, especially in matters of shape, size, materials and arrangement of parts within the principles of the invention to the full extent indicated by the broad general meaning of is the terms in which the appended claims are expressed.

What is claimed is:

1. A clay sculpturing kit, comprising:

a piece of clay;

at least one sculpturing tool for shaping the clay to form a sculpture;

a pedestal including a base, a covering, and at least one skid resistant support projected from a bottom surface of the base, the covering being receivable on the base which defines a space in which the clay and the at least one sculpturing tool are stored, the covering including a top wall having a top surface and side walls, the sculpture being placed to stand on the top surface of the top wall when the sculpture is displayed, so that the pedestal stores the clay and the at least one sculpturing tool, fashions and shapes the clay to form the sculpture, and supports and displays the sculpture when completed; and wherein the space further contains a light source, the covering includes an aperture on the top wall such that when the light source is turned on, light shines through the aperture substantially illuminating the sculpture displayed on the top surface of the top wall.

2. A clay sculpturing kit according to claim 1, further including instruction materials containing instructions on how to fashion and shape the clay to form the sculpture, the instruction materials being stored in the pedestal.

3. A clay sculpturing kit according to claim 1, wherein the side walls have an inner bottom edge and an outer bottom edge, the inner bottom edge defining a footprint smaller than the base, the outer bottom edge defining a footprint larger than the base whereby when the covering covers the base, the inner bottom edge rests on the base, and the outer bottom edge extends at least to the bottom surface of the base thereby obscuring the base from view.

4. A clay sculpturing kit according to claim 1, wherein the clay includes a set of different colored clays, at least one partition is attached to a top surface of the base for storing the clays.

5. A clay sculpturing kit according to claim 4, wherein the set of different colored clays includes four different colored clays, the at least one partition has three partitions, each of the colored clays is stored in a different compartment defined by the partitions.

6. A clay sculpturing kit according to claim 1, wherein the covering is substantially hard, glossy, and opaque.

7. A clay sculpturing kit according to claim 1, wherein the covering is dark in color, and the at least one skid resistant support is off-white in color.

8. A clay sculpturing kit according to claim 1, wherein the covering is substantially white in color.

9. A clay kit, comprising:

a piece of clay;

tool means for sculpturing the clay into a sculpture; and pedestal means for storing the clay and tool means, for fashioning and shaping the clay into the sculpture, and for displaying the sculpture which is placed to stand on a top surface of the pedestal means, the pedestal means including skid resistant support means for supporting the pedestal means, the pedestal means including a covering and a base, the covering being receivable on the base to define a space for storing the clay and the sculpturing tool means, the covering substantially obscuring the base from view when received on the base; and wherein the space further contains a light source, the covering includes an aperture on the top wall such that when the light source is turned on, light shines through the aperture substantially illuminating the sculpture displayed on the top surface of the top wall.

* * * * *